US005095548A

United States Patent [19]

Chesebro, Jr.

[11] Patent Number: 5,095,548

[45] Date of Patent: Mar. 17, 1992

[54] MOISTURE CONTROL SOCK

[75] Inventor: Robert E. Chesebro, Jr., Sheboygan, Wis.

[73] Assignee: Wigwam Mills, Inc., Sheboygan, Wis.

[21] Appl. No.: 648,887

[22] Filed: Jan. 31, 1991

[51] Int. Cl.[5] ..... A41B 11/00

[52] U.S. Cl. ..... 2/239; 2/241; 66/171; 66/178 R; 66/178 A; 66/183; 66/184; 66/185; 66/186; 66/187; 66/196; 66/201

[58] Field of Search ..... 2/239, 241; 66/171, 66/178 R, 178 A, 183, 184, 185, 186, 187, 196, 201

[56] References Cited

U.S. PATENT DOCUMENTS

| | | | |
|---|---|---|---|
| 3,250,095 | 5/1966 | Bird | 66/178 R |
| 3,796,067 | 3/1974 | East | 66/178 R |
| 4,341,096 | 7/1982 | Safrit et al. | 2/239 |
| 4,373,361 | 2/1983 | Thorneburg | 2/241 |
| 4,520,635 | 6/1985 | Shields et al. | 2/239 |
| 4,615,188 | 10/1986 | Hursh et al. | 2/239 |
| 4,898,007 | 2/1990 | Dahlgren | 2/239 |

FOREIGN PATENT DOCUMENTS

| | | | |
|---|---|---|---|
| 7907044 | 4/1980 | Netherlands | 2/241 |

*Primary Examiner*—Werner H. Schroeder
*Assistant Examiner*—Gloria Hale
*Attorney, Agent, or Firm*—Bell, Seltzer, Park & Gibson

[57] ABSTRACT

Moisture control characteristics are imparted to the sock of the present invention by body yarn knit in successive courses throughout the leg and foot. A hydrophobic yarn is knit in plated relationship with the body yarn in partial courses extending throughout the sole, and hydrophilic yarn is knit in plated relationship with the body yarn in partial courses extending throughout the instep whereby moisture generated by the foot of the wearer is wicked and transported from the sole and into the instep to be evaporated therefrom. Cut free ends extend from the endmost stitch loops in wales along the juncture of the sole and the instep while cut free ends of the hydrophilic yarn extend from endmost stitch loops in wales along the juncture of the sole and instep so that the endmost stitch loops at opposite ends of the partial courses of the hydrophobic and hydrophilic yarns are formed in adjacent wales and are not knit in plated relationship with each other in the same courses.

11 Claims, 2 Drawing Sheets

MOISTURE CONTROL SOCK

FIELD OF THE INVENTION

This invention relates generally to a sock which includes moisture control characteristics in the foot, and more particularly to such a sock with body yarn knit in successive courses throughout the leg and foot, hydrophobic yarn knit in plated relationship with the body yarn in partial courses extending throughout the sole of the foot, and hydrophilic yarn knit in plated relationship with the body yarn in partial courses extending throughout the instep of the foot so that moisture generated by the foot of the wearer is wicked by the sole and transported from the sole to the instep to be evaporated therefrom.

BACKGROUND OF THE INVENTION

It has been the general practice to provide moisture control characteristics in the foot of a sock by knitting both hydrophobic and hydrophilic yarns in plated relationship throughout the foot and with the hydrophobic yarn plated on the inside of the foot while the hydrophilic yarn is plated on the outside of the sock so that moisture generated by the foot of the wearer is wicked and transported outwardly away from the foot by the hydrophobic yarn and is absorbed and evaporated from the sock by the hydrophilic yarn. Since the shoe covers at least a major portion of the foot of the sock, the wicking of the moisture from the inner surface to the outer surface of the foot of the sock and evaporation of the moisture from the outer surface is not very efficient, particularly when a great amount of moisture is generated by the foot of the wearer when engaging in athletic activities.

U.S. Pat. No. 4,898,007 discloses a moisture management sock in which the heel and toe portions of the foot are knit predominately, or entirely, of hydrophilic yarn while the middle portion of the foot extending therebetween is knit of hydrophobic yarn. According to this patent, moisture absorbed from the wearer's foot by the hydrophilic yarn in the toe and heel portions is transferred by wicking action into the hydrophobic yarn in the medial portion of the foot to be evaporated therefrom. Thus, the foot of the sock is divided into a first zone at the toe of the sock which is knit predominately of hydrophilic yarn, a second zone at the heel of the sock which is also knit predominately of hydrophilic yarn, and a third zone extending between the heel and toe which is knit predominately of hydrophobic yarn. The first toe zone and the second heel zone are joined to the third medial or instep zone along juncture lines extending in a coursewise direction. This type of moisture management sock may not provide sufficient evaporation of the moisture generated by the foot of the wearer, particularly when the sock is used during athletic activities and a great amount of moisture is generated by the foot of the wearer.

It is also known to knit "splitfoot" socks in which the lower half or sole of the foot is knit of a yarn of one color, usually white, while the upper half or instep of the foot is knit of another color of yarn. U.S. Pat. No. 721,190 discloses an example of this type of "splitfoot" sock in which the yarn forming the lower half or sole of the foot is knit in partial courses of one yarn with free cut ends at opposite sides thereof, where the sole joins the instep. The instep is knit in partial courses of another yarn with free out ends with the partial courses of the sole yarn. The partial courses of the instep yarn overlap the partial courses of the sole yarn in a pair of common wales at the juncture of the sole and instep. This formation of wales of plated stitch loops formed of both the instep and sole yarns extending along opposite sides of the foot of the sock forms a heavy ridge or thickened fabric area therealong.

SUMMARY OF THE INVENTION

With the foregoing in mind, it is an object of the present invention to provide a moisture control sock in which body yarn is knit in successive courses throughout the sock, hydrophobic yarn is knit in plated relationship with the body yarn in partial courses extending throughout the sole, and hydrophilic yarn is knit in plated relationship with the body yarn in partial courses extending throughout the instep so that moisture generated by the foot of the wearer is wicked by the sole and transported from the sole to the instep to be evaporated therefrom.

The moisture control sock of the present invention has cut free ends of the hydrophobic yarn knit in the partial courses of the sole extending from endmost stitch loops in wales along the juncture of the sole and instep and has cut free ends of the hydrophilic yarn knit in the partial courses of the instep extending from endmost stitch loops in wales along the juncture of the sole and instep. The endmost stitch loops at opposite ends of the partial courses of the hydrophobic and hydrophilic yarns are formed in adjacent wales and the hydrophobic and hydrophilic yarns are not knit in overlapping relationship in the same wales.

The endmost stitch loops at opposite ends of alternate single partial courses of the hydrophobic yarn in the sole are offset walewise by a plurality of wales, preferably three wales, relative to the endmost stitch loops at opposite ends of intervening single of the partial courses of the hydrophilic yarn in the instep. Thus, the opposite ends of the intervening single partial courses of the hydrophilic yarn in the instep are staggered relative to the opposite ends of the alternate single partial courses of the hydrophobic yarn in the sole and are not knit together in common wales along the juncture of the sole and instep. It is preferred that the hydrophobic yarn knit in plated relationship with the body yarn in partial courses extending throughout the sole forms terry loops inside of the sole.

It is preferred that the hydrophobic yarn knit in plated relationship with the body yarn in partial courses extending throughout the sole is also knit in plated relationship with the body yarn throughout the heel and toe. The hydrophobic yarn knit in plated relationship with the body yarn throughout the heel and toe also preferably forms terry loops inside of the heel and toe. In a preferred form, the hydrophobic yarn is also knit in plated relationship with the body yarn throughout a high splice area above the heel with the hydrophobic yarn also forming terry loops inside of the high splice area.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
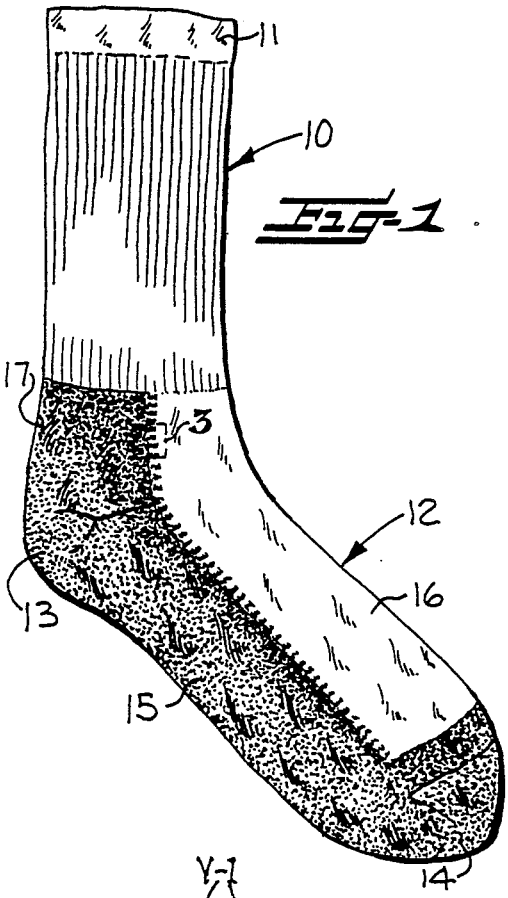
FIG. 1 is an elevational view of one side of the sock of the present invention, in flattened condition.
Figure 2:
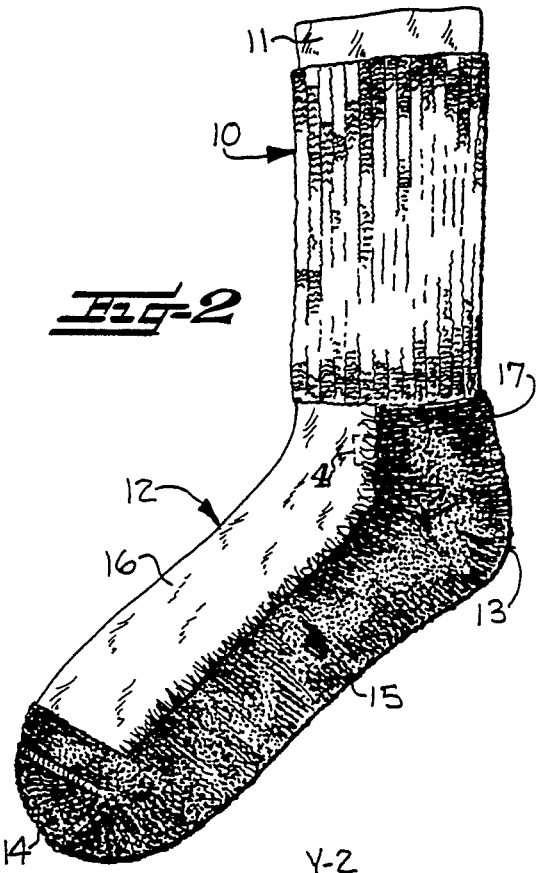
FIG. 2 is a view similar to FIG. 1 but showing the sock of the present invention in everted condition.
Figure 3:
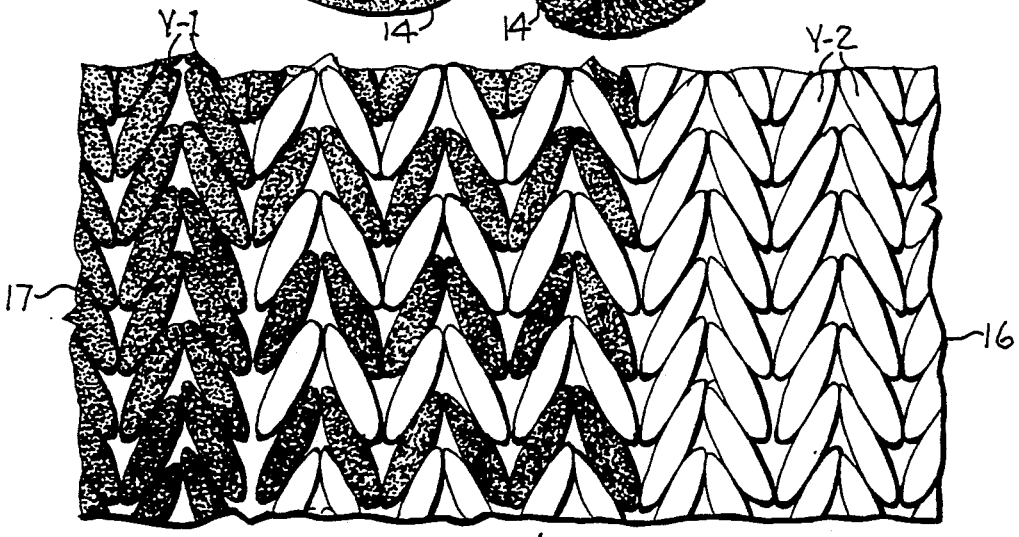
FIG. 3 is a greatly enlarged fragmentary view of a small portion of the juncture between the sole and instep, looking at the outside of the sock and being taken in the,, rectangular area 3 in FIG. 1.

As illustrated in FIGS. 1 and 2, the moisture control sock of the present invention includes a leg, broadly indicated at 10, and an integrally knit foot, broadly indicated at 12. The leg 10 includes an upper cuff portion 11 while the foot 12 includes a heel 13 at one end, a toe 14 at the other end, a sole 15 extending between the heel 13 and the toe 14 and around the lower half of the foot 12, and an instep 16 joined along opposite sides to opposite sides of the sole 15 and extending around the upper half of the foot. A high splice area 17 is provided above the heel 13.

Figure 4:
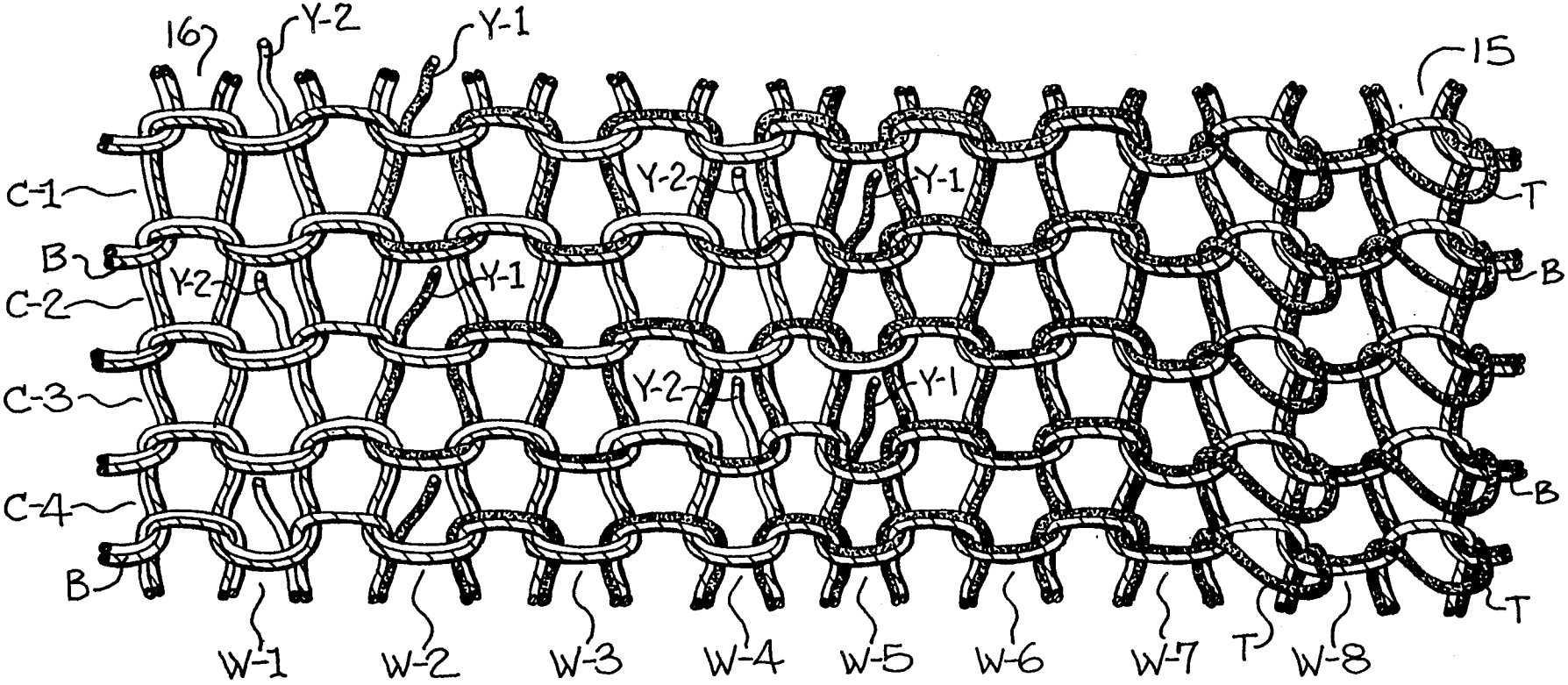
FIG. 4 is a greatly enlarged fragmentary view illustrating the stitch construction along a fragmentary portion of the juncture of the instep and the sole, being taken in the rectangular area 4 in FIG. 2.

Body yarn, indicated at B in FIG. 4 (identified by striped lines), is knit in successive courses throughout the leg 10 and foot 12 while hydrophobic yarn Y-1 (identified by speckling) is knit in plated relationship with the body yarn B in partial courses extending throughout the sole 15, the high splice area 17, the heel 13, and the toe 14. The partial courses of the hydrophobic yarn Y-1 extend around and throughout the sole 15 in the lower half of the foot, throughout the heel 13 and toe 14, and around the rear half of the leg 10 in the high splice area 17.

As illustrated in FIG. 4, the hydrophobic yarn Y-1 knit in the partial courses of the sole 15 has cut free ends extending from endmost stitch loops, as illustrated in wale W-2 of alternate single partial courses C-1 and C-3, while the hydrophobic yarn Y-1 has cut free ends extending from the endmost stitch loops, as illustrated in wale W-5 of intervening single partial courses in courses C-2 and C-4. Hydrophilic yarn, indicated at Y-2 in FIG. 4 (illustrated as being plain white), is knit in plated relationship with the body yarn B in partial courses extending throughout the instep 16 and around the front of the leg 10 opposite the high splice area 17. Cut free ends of the hydrophilic yarn Y-2 extend from endmost stitch loops, as illustrated in wale W-1 of alternate single partial courses C-1 and C-3, and has cut free ends extending from endmost stitch loops, as illustrated in wale W-4 of intervening single partial courses C-2 and C-4. Thus, endmost stitch loops at opposite ends of the partial courses of the hydrophobic yarn Y-1 and the hydrophilic yarn Y-2 are formed in adjacent wales in each course. The endmost stitch loops at opposite ends of alternate single of the partial courses of the hydrophobic yarn Y-1 in the sole are offset or staggered walewise by three wales (wales W-2, W-3 and W-4) relative to the endmost stitch loops at opposite ends of intervening single of the partial courses of the hydrophilic yarn Y-2 in the instep 16. As illustrated in the sinker wales adjacent the needle wales W-7 and W-8, it is preferred that the hydrophobic yarn Y-1 forms terry loops T inside of the sock and in the high splice area 17, the heel 13, the sole 15, and the toe 14.

The moisture generated by the wearer's foot, particularly along the bottom of the foot, is wicked and transported from the heel 13, the sole 15, and the toe 14 up and into the instep 16 where it is absorbed and moves upwardly therealong to the leg 10 where it is evaporated therefrom. The moisture generated above the heel is wicked and transported from the high splice area 17 to the front of the leg 10 and evaporated therefrom. When worn with lace-up shoes, some of the moisture may be evaporated from the instep 16 through the lace area of the shoe.

Moisture control is provided in the present sock by utilizing hydrophobic yarn predominately in the lower half of the foot and hydrophilic yarn predominately in the upper half of the foot with the ends of the partial courses of each of the hydrophobic and hydrophilic yarns terminating along walewise extending juncture lines along opposite sides of the foot of the sock. This arrangement facilitates the wicking of moisture in the bottom of the foot and movement of the moisture to the upper part of the foot and up the leg to be evaporated therefrom. This wicking of the moisture from the bottom of the foot to the instep helps to maintain the bottom of the foot of the wearer dry and, therefore, prevents blisters and other related foot diseases. This movement of the moisture from the bottom of the foot to the top where it is evaporated also reduces the cold, clammy feeling on the foot of the wearer.

As a specific but nonlimiting example, it has been found that a satisfactory moisture control sock can be formed by knitting a 2/70's stretch nylon (hydrophobic) body yarn B throughout the leg 10 and foot 12 of the sock. The hydrophobic yarn Y-1 knit in plated relationship with the body yarn B in partial courses extending throughout the high splice 17, heel 13, sole 15, and toe 14 is an olefin 1/40's yarn while the hydrophilic yarn Y-2 knit in plated relationship with the body yarn B in partial courses extending throughout the instep 16 is a blend of a 65% moisture absorbing acrylic and 35% cotton 1/36's yarn. The hydrophilic yarn Y-2 is also knit in plated relationship with the body yarn B throughout the leg 10. The cuff 11 can be any of the well-known elastic cuff types currently being produced and the leg 10 may have elastic yarn incorporated therein to form a mock rib, with or without terry loops formed on the inside of the leg 10.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A sock including integrally knit leg and foot portions, said foot portion including a heel at one end, a toe at the other end, a sole extending between said heel and toe and extending around the lower half of said foot, and an instep joined along a pair of opposite sides to a corresponding pair of opposite sides of said sole and extending around the upper half of said foot, said sock comprising (a) body yarn knit in successive courses throughout said leg and foot, (b) hydrophobic yarn knit in plated relationship with said body yarn in partial courses extending throughout said sole, and (c) hydrophilic yarn knit in plated relationship with said body yarn in partial courses extending throughout said instep whereby moisture generated by the foot of the wearer is transported from said sole to said instep to be evaporated therefrom.

2. A sock according to claim 1 wherein said hydrophobic yarn knit in said partial courses of said sole has cut free ends extending from endmost stitch loops in wales along the juncture of said sole and instep, said hydrophilic yarn knit in said partial courses of said instep has cut free ends extending from endmost stitch loops in wales along the juncture of said sole and instep, and wherein said endmost stitch loops of said partial courses of said hydrophobic and said hydrophilic yarns are formed in adjacent wales.

3. A sock according to claim 2 wherein said endmost stitch loops of alternate single partial courses of said hydrophobic yarn in said sole are offset walewise by a plurality of wales relative to said endmost stitch loops of intervening single of said partial courses of said hydrophilic yarn in said instep.

4. A sock according to claim 3 wherein said endmost stitch loops of said alternate single of said partial courses of said hydrophobic yarn in said sole are offset walewise by three wales relative to said endmost stitch loops at opposite ends of said intervening single of said partial courses of said hydrophilic yarn in said instep.

5. A sock according to claim 1 wherein said hydrophobic yarn knit in plated relationship with said body yarn in partial courses extending throughout said sole forms terry loops inside of said sole.

6. A sock according to claim 1 wherein said hydrophobic yarn knit in plated relationship with said body yarn in partial courses extending throughout said sole is also knit in plated relationship with said body yarn throughout said heel and toe.

7. A sock according to claim 6 wherein said hydrophobic yarn knit in plated relationship with said body yarn throughout said heel and toe forms terry loops inside of said heel and toe.

8. A sock according to claim 6 including a high splice area above said heel, and wherein said hydrophobic yarn is knit in plated relationship with said body yarn throughout said high splice area.

9. A sock according to claim 8 wherein said hydrophobic yarn knit in plated relationship with said body yarn throughout said high splice area forms terry loops inside of said high splice area.

10. A sock including integrally knit leg and foot portions, said foot portion including a heel at one end, a toe at the other end, a sole extending between said heel and toe and extending around the lower half of said foot, and an instep joined along a pair of opposite sides to a corresponding pair of opposite sides of said sole and extending around the upper hal of said foot, said sock comprising (a) body yarn knit in successive courses throughout said leg and foot, (b) hydrophobic yarn knit in plated relationship with said body yarn in partial courses extending throughout said sole, and throughout said heel and toe, (c) hydrophilic yarn knit in plated relationship with said body yarn in partial courses extending throughout said instep, and (d) wherein said hydrophobic yarn knit in said partial courses of said sole has cut free ends extending from endmost stitch loops in wales along the juncture of said sole and instep, said hydrophilic yarn knit in said partial courses of said instep has cut free ends extending from endmost stitch loops in wales along the juncture of said sole and instep, and wherein said endmost stitch loops of said partial courses of said hydrophobic and said hydrophilic yarns are formed in adjacent wales so that moisture generated by the foot of the wearer is transported from said sole to said instep to be evaporated therefrom.

11. A sock according to claim 10 wherein said hydrophobic yarn knit in plated relationship with said body yarn throughout said sole, heel and toe forms terry loops inside of said sole, heel and toe.

* * * * *

UNITED STATES PATENT AND TRADEMARK OFFICE

CERTIFICATE OF CORRECTION

PATENT NO. : 5,095,548

DATED : March 17, 1992

INVENTOR(S) : Robert E. Chesebro, Jr.

It is certified that error appears in the above-identified patent and that said Letters Patent is hereby corrected as shown below:

On the title page: under [56 References Cited], the following references were omitted and should be added:

| | | | |
|---|---|---|---|
| 721,190 | 2/1903 | Hirner | 66/187 |
| 882,951 | 3/1908 | Mettler | 66/187 |
| 1,390,827 | 9/1921 | Smith | 66/185 |
| 1,769,856 | 7/1930 | Page | 66/187 |
| 2,000,615 | 5/1935 | Roth | 66/202 |
| 2,010,187 | 8/1935 | Grothey | 66/185 |

Column 3, line 6, "the,," should be -- the --.

Column 6, line 13, "hal" should be -- half --.

Signed and Sealed this

Twenty-ninth Day of June, 1993

*Attest:*

*Attesting Officer*

Michael K. Kirk

MICHAEL K. KIRK

*Acting Commissioner of Patents and Trademarks*